US005397667A

United States Patent [19]

Law et al.

[11] Patent Number: 5,397,667

[45] Date of Patent: Mar. 14, 1995

[54] TONER WITH METALLIZED SILICA PARTICLES

[75] Inventors: Kock-Yee Law, Penfield; Ihor W. Tarnawskyj, Webster, both of N.Y.

[73] Assignee: Xerox Corporation, Stamford, Conn.

[21] Appl. No.: 234,206

[22] Filed: Apr. 28, 1994

[51] Int. Cl.[6] ..... G03G 9/097

[52] U.S. Cl. ..... 430/106; 430/106.6; 430/108; 430/110

[58] Field of Search ..... 430/106, 106.6, 110

[56] References Cited

U.S. PATENT DOCUMENTS

| | | | |
|---|---|---|---|
| 2,657,149 | 10/1953 | Iler et al. . | |
| 3,590,000 | 6/1971 | Palermiti et al. . | |
| 3,800,588 | 4/1974 | Larson et al. | 73/71.6 |
| 4,560,635 | 12/1985 | Hoffend et al. | 430/106.6 |
| 4,824,752 | 4/1989 | Yasuda et al. | 430/106.6 |
| 5,102,763 | 4/1992 | Winnik et al. | 430/110 |
| 5,176,979 | 1/1993 | Eguchi et al. | 430/110 |
| 5,256,514 | 10/1993 | Law et al. | 430/106.6 |
| 5,306,588 | 4/1994 | Tanaka et al. | 430/110 |

FOREIGN PATENT DOCUMENTS

| | | | |
|---|---|---|---|
| 204069 | 8/1989 | Japan | 430/110 |
| 340972 | 11/1992 | Japan | 430/110 |

OTHER PUBLICATIONS

Proceedings of the Academy of Sciences, USSR Phys. Chem. Engl. Transl., 114, 421, (1957).

Handbook of Imaging Materials, p. 169, 1991, edited by A. S. Diamond.

The Chemistry of Silica, R. K. Iler, p. 654, 1979.

Esterification of the Surface of Amorphous Silica, C. C. Ballard et al, vol. 65, pp. 20–25.

*Primary Examiner*—Roland Martin

*Attorney, Agent, or Firm*—E. O. Palazzo

[57] ABSTRACT

A toner composition comprised of resin, pigment, optional charge additive and a flow aid surface additive comprised of hydrophobic metallized silica of a size diameter of from about 5 to about 40 nanometers, and which silica has been treated with a long chain aliphatic alcohol.

29 Claims, No Drawings

TONER WITH METALLIZED SILICA PARTICLES

BACKGROUND OF THE INVENTION

This invention is generally directed to toner and developer compositions, and more specifically, the present invention is directed to developer and toner compositions containing modified, for example surface treated, colloidal silica particles, including the known AEROSILS® available from Degussa, Inc., and which particles can be selected for toners with rapid admix, excellent flow, and acceptable triboelectrical characteristics. In embodiments, there are provided in accordance with the present invention toner compositions comprised of resin particles, pigment particles, optional charge additives, such as quaternary ammonium hydrogen bisulfates, including distearyl methyl hydrogen ammonium bisulfates; distearyl dimethyl ammonium methyl sulfate; alkyl pyridinium halides; metal complexes such as aluminum complexes, reference U.S. Pat. No. 4,845,003, the disclosure of which is totally incorporated herein by reference; TRH, reference U.S. Pat. Nos. 4,758,493 and 4,433,040, the disclosure of which are totally incorporated herein by reference; and more specifically, 3,5-di-tertiary-butylsalicylic acid, and its salts; BONTRON E-82 TM; BONTRON E-84 TM; BONTRON E-88 TM; halogenated salicylic acids; LR120 TM, available from Carlit Inc. of Japan, and the like; and metallized, especially metal hydroxides like lithium, silica particles, like AEROSILS® as surface additives. The metallized silica particles can be modified by a process which comprises the coating thereof with components that will, for example, reduce and regulate the moisture content thereof enabling the generation of a higher negative toner tribo and a toner with improved relative humidity resistivity as compared to toners wherein untreated, that is colloidal silicas not subject to the alcohol treatment processes of the present invention, are selected. In embodiments, a number of long chain alcohols can be selected for treating the silica surface. Examples of treating components include long chain aliphatic alcohols, wherein aliphatic is preferably alkyl with from 12 to about 30 carbon atoms. Toners with the aforementioned treated metallized surface additives in embodiments of the present invention possess rapid admix of less than about one minute, extended developer life, stable electrical properties, high image print quality with substantially no background deposits, and improved insensitivity to relative humidity of, for example, from 20 to 80 percent RH. Also, the aforementioned toner compositions usually contain pigment particles comprised of, for example, carbon black, magnetites, or mixtures thereof, cyan, magenta, yellow, blue, green, red, or brown components, or mixtures thereof thereby providing for the development and generation of black and/or colored images. The toner compositions of the present invention in embodiments thereof possess excellent admix characteristics as indicated herein, and maintain their triboelectric charging characteristics for an extended number of imaging cycles exceeding, for example, 1,000,000 in a number of embodiments. The toner and developer compositions of the present invention can be selected for electrophotographic, especially xerographic, imaging and printing processes, including full color processes and trilevel color processes.

Illustrated in *The Chemistry Of Silica,* R. K. Iler, John Wiley and Sons, page 654, 1979, *Dokl. Akad. Nauk USSR,* 125, 1247(1959), and in *Proceedings Academy Sciences USSR Phys. Chem. Engl. Transl.,* 114, 421, (1957) is the adsorption of alcohols, such as hexyl alcohol, from carbon tetrachloride on the surface of silicas that were dehydroxylated. *The Handbook Of Imaging Materials,* Edited By Arthur S. Diamond, page 169, 1991, which indicates that good flow properties are usually desired and often are critical for toners, and that materials, such as fumed silicas, can be added to the surface of a toner to improve flow, and can improve charge stability of the toner and carrier mixture.

The above prior art relates, for example, to silica gels, which are hydrophilic, and thus sensitive to relative humidity, and further in the above paper *Proceedings Academy Sciences USSR Phys. Chem. Engl. Transl.,* 114, 421, (1957) it is indicated that the adsorption of long chain alcohols, such as 1-octadecanol is not effective as they cannot penetrate into the surface of the silica gel. While not being desired to be limited by theory, it is believed that the hydrocarbon layer based on DSC is formed with the invention processes since the hydroxy groups on the alcohol molecules form hydrogen bonds with the silica surface, and a hydrophobic interaction occurs between the aliphatic chains which bound together by Van der Waals forces, and thus enable a substantially permanent protective layer for the silica particles.

Developer compositions with colloidal silica surface components and charge enhancing additives, which impart a positive charge to the toner resin, are known. Thus, for example, there is described in U.S. Pat. No. 3,893,935 the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchlorate, tetrafluoroborate, benzene sulfonate, and the like; U.S. Pat. No. 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example, sulfate, sulfonate, nitrate, borate, chlorate, and the halogens such as iodide, chloride and bromide, reference the Abstract of the Disclosure and column 3; a similar teaching is presented in U.S. Pat. No. 4,312,933 which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition and AEROSIL ® surface additives. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds and AEROSIL ® surface additives. Additionally, other documents disclosing positively charged toner compositions with charge control additives and AEROSIL ® surface additives include U.S. Pat. Nos. 3,944,493; 4,007,293; 4,079,014; 4,394,433 and 4,560,635 which illustrates a toner with a distearyl dimethyl ammonium methyl sulfate charge additive. One disadvantage associated with the charge additive of the '635 patent resides in its apparent inherent instability in some instances thus rendering it substantially unsuitable as a bulk toner constituent in imaging processes, as the additive can thermally and chemically degrade, and react with other toner components.

Moreover, toner compositions with negative charge enhancing additives and surface additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives. Toners with colloidal silica surface additives are illustrated in U.S. Pat. Nos. 3,590,000 and 3,800,588, the disclosures of which are totally incorporated herein by reference. Also, U.S. Pat. Nos. 5,256,514, and 5,256,515, illustrate negatively charged toners with certain charge additives adsorbed on silica surfaces. The disclosures of each of the aforementioned patents are totally incorporated herein by reference.

There are illustrated in the following copending applications filed concurrently herewith, the disclosures of which, are totally incorporated herein by reference: U.S. Ser. No. 234,074 illustrates a toner composition comprised of resin, pigment, optional charge additive and a flow aid surface additive comprised of hydrophobic silica of a size diameter of from about 5 to about 40 nanometers and which silica has been treated with a long chain aliphatic alcohol; and U.S. Ser. No. 234,076 illustrates a toner composition comprised of resin, pigment, optional charge additive and a hydrophobic flow aid surface additive comprised of grafted alcoholic silicas.

SUMMARY OF THE INVENTION

It is an object of the present invention to provide toner and developer compositions and processes thereof.

In another object of the present invention there are provided positively, or negatively and preferably negatively charged toner compositions useful for the development of electrostatic latent images including color images.

In yet another object of the present invention there are provided improved toner compositions containing metallized colloidal silica like AEROSIL ® particles and wherein the toners possess resistance to relative humidity, and improved, or reduced toner relative humidity sensitivity; and excellent flow characteristics; and more specifically wherein the toner has improved tribo triboelectrical characteristics at high relative humidity, for example at 80 percent, and wherein the improved tribo translates into a higher toner triboelectric value at higher RH.

In yet another object of the present invention there are provided processes for the preparation of modified metallized silica particles.

Also, in another object of the present invention there are provided developer compositions containing the toners illustrated herein and with the modified metallized silica, or AEROSIL ® particles.

In yet a further object of the present invention there are provided improved humidity insensitive, from about, for example, 20 to 80 percent relative humidity at temperatures of from 60° F. to 80° F. as determined in a relative humidity testing chamber, toner compositions with desirable admix properties of from about 5 seconds to about 60 seconds as determined by the charge spectrograph, and preferably less than 15 seconds for example, and more preferably from about 1 to about 14 seconds, and acceptable triboelectric charging characteristics of from about 10 to about 50 microcoulombs per gram.

Another object of the present invention resides in the formation of toners which will enable the development of images in electrophotographic imaging apparatuses, which images have substantially no background deposits thereon, are substantially smudge proof or smudge resistant, and therefore are of excellent resolution; and further, such toner compositions can be selected for high speed electrophotographic apparatuses, that is those exceeding 70 copies per minute.

These and other objects of the present invention can be accomplished in embodiments thereof by providing toner compositions comprised of resin particles, pigment particles, optional charge enhancing additives, and metallized silica particles. In embodiments, the present invention is directed to the toner use of and processes for the preparation of metallized modified silica particles by the adsorption thereof with long chain aliphatic alcohols, long chain aliphatic acids, long chain aliphatic amines, and long chain aliphatic mercaptans. More specifically, the long chain alcohols are adsorbed on the hydrophobic silica surface and wherein the polar groups in the alcohol interact with the surface, of the dipole-dipole and/or by H-bonding interactions. The hydrocarbon chains of the alcohol interact by Van der Waals forces forming a hydrocarbon layer on the hydrophobic silica thereby ,for example, protecting the silica from moisture attack.

The process of the present invention in embodiments comprises adding a metallized hydrophobic silica to a hydrocarbon solution containing a long chain alcohol. The metallized silica can be prepared by neutralizing the acid groups on the surface of the silica, such as AEROSIL R972 ® with a metal hydroxide, such as lithium hydroxide, sodium hydroxide, and potassium hydroxide. Hydrophobic silicas are preferred in embodiments in that they significantly reduce the relative humidity sensitivity. Various hydrocarbon solutions can be selected such as solutions of pentane, hexane, heptane, octane, cyclopentane, cyclohexane, mixtures thereof, and the like. Small effective amounts of other components, such as ethers like aliphatic ethers of, for example, diethyl ether, dipropyl ether, and dibutylether, in an amount of, for example, 0.3 weight percent can be added to assist in the solubility of the alcohol in the coating solution.

Examples of long chain alcohols that can be selected include those with from about 12 to about 30 carbon atoms and preferably from about 12 to about 20 carbon atoms such as dodecanol, tetradecanol, hexadecanol, octadecanol, eicosanol, docosanol and alcohols with an odd number of carbon atoms. The alcohol can be normal, secondary, tertiary, or branched, and the ratio of the silica to alcohol can vary to be from about 100:5 to about 100:50, with the preferred range ratio being from about 100:10 to about 100:40. Also, for 3 grams of silica, the amount of coating solvent such as hexane or pentane, cyclopentane, cyclohexane, can be from about 10 to about 200 milliliters with from about 50 to about 150 milliliters being preferred. During the coating process of the silica, ultrasonication can also be utilized to break up the agglomerated silica. Silica particles of a primary particle size ranging from about 5 to about 40, and about 6 to about 20 nanometers are especially preferred. After stirring the mixture of long chain alcohol, hydrophobic silica and solvent for from about 0.5 hour to overnight, about 21 hours, the coating solvent can be removed by, for example, a rotating evaporator, resulting in an alcohol modified silica, that is where the alcohol or the hydrocarbon chain thereof is present on the silica surface as evidenced by DSC, IR, and NMR. The aforementioned modified silica can be incorporated into toner and developers, especially toners that are negatively charged, providing compositions with improved relative humidity sensitivity of from about 20 to about 80 percent relative humidity as compared to toners and developers without the adsorbed modified silicas of the present invention. Thus, with the process of the present invention there is formed a hydrophobic protective layer on the hydrophobic metallized silica; the alcohol is anchored on the silica surface by hydrogen bonding while the hydrocarbon chains of the alcohol interact with each other on the silica surface by Van der Waals forces to form or generate the protective layer.

With further respect to the metallized silica particles, they can be prepared by neutralizing the silanol groups present on the silica surface with a metal hydroxide. By neutralization is meant that the silanol acidic group on the surface of the hydrophobic silica are neutralized by a metal hydroxide, such as LiOH, NaOH, and KOH. The neutralization process is usually accomplished in an alcoholic solvent such as methanol or ethanol. For each gram of silica, 0.5 to 3 milliliters of a diluted, for example $1\times10^{-3}$ N, solution of the metal hydroxide solution can be used. For the neutralization process, the alcohol solvent is removed by evaporation. Each gram of this silica will be metallized with from half (0.5) to 3 micromoles of the metal hydroxide on the surface.

In embodiments, the metallized silica can be prepared as follows: a silica (AEROSIL R972 ® from Degussa Chemical), 4 grams, was suspended in 100 milliliters of methanol inside a 250 milliliter round bottom flask. The silanol acidic groups in the AEROSIL ® were then neutralized by adding an aqueous solution of lithium hydroxide ($1\times10^{-3}$ N, 4 milliliters) until the pH is 7 as indicated by a pH meter. The resulting mixture was then stirred for 1 hour and the solvent methanol was removed by evaporation. The metallized silica, which consists of ~1 micromole of LiOH on the surface of each gram of R972 ®, was obtained after vacuum drying at 80°-100° C. overnight. 1-Hexadecanol (0.3 gram) was dissolved in ~100 milliliters of hexane inside a 250 milliliter round bottom flask. The above metallized silica (3 grams) was added and the suspension was stirred overnight (16 to 20 hours). The hexane solvent was then removed on a known evaporator. The residue obtained was placed in a crystallization dish and was dried in an oven overnight at 70° C. The solid was then transferred to a 4 ounce bottle and roll milled with 35 grams of ¼ inch steel shot for 30 minutes at a speed of about 90 feet/minute, yielding ~3 grams of a fluffy white powder, the alcohol modified metallized silica of ~10 percent of 1-hexadecanol adsorbed on the surface of a hydrophobic metallized silica.

The toner compositions can be comprised of resin, pigment, or dye, known optional negative charge additive and the metallized, or modified metallized surface silica additives prepared, for example, by the processes illustrated herein. Examples of specific negative charge enhancing additives include 3,5-di-tertiarybutylsalicyclic acid, lithium, 3,5-di-tertiarybutylsalicylate, BONTRON E-84 TM, BONTRON E-88 TM, LR120 TM, 3,5-diiodosalicylic acid, its salts, and the corresponding aluminum, zinc, and boron complexes. Advantages of rapid admix, appropriate triboelectric characteristics, relative humidity resistance, and the like are achieved with many of the aforementioned toners of the present invention.

In another embodiment of the present invention there are provided, subsequent to known micronization and classification, toner particles with an average volume diameter of from about 4 to about 20 microns.

The toner compositions of the present invention can be prepared by a number of known methods such as admixing and heating resin particles, such as styrene butadiene copolymers, polyesters like SPAR TM and crosslinked polyesters as illustrated in U.S. Pat. No. 5,227,460, the disclosure of which is totally incorporated herein by reference, pigment particles such as magnetite, carbon black, or mixtures thereof, preferably from about 0.5 percent to about 5 percent of charge enhancing additives, or mixtures of charge additives in a toner extrusion device, such as the ZSK53 available from Werner Pfleiderer, and removing the formed toner composition from the device followed by the addition of the metallized, or modified metallized silica particles prepared by the processes illustrated herein, and with a protective coating or layer. Subsequent to cooling, the toner composition is subjected to grinding utilizing, for example, a Sturtevant micronizer for the purpose of achieving toner particles with a volume median diameter of less than about 25 microns, and preferably of from about 4 to about 12 microns, which diameters are determined by a Coulter Counter. Subsequently, the toner compositions can be classified utilizing, for example, a Donaldson Model B classifier for the purpose of removing fines, that is toner particles less than about 2 microns volume median diameter.

Illustrative examples of suitable toner resins selected for the toner and developer compositions of the present invention include polyesters, especially the extruded crosslinked polyesters of U.S. Pat. No. 5,227,460, polyamides, polyolefins, styrene acrylates, styrene methacrylates, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide, mixtures thereof; and the like. Specific resins include styrene butadiene copolymers, with a styrene content of from about 70 to about 95 weight percent, reference the U.S. patents mentioned herein, the disclosures of which have been totally incorporated herein by reference. In addition, crosslinked resins, including polymers, copolymers, homopolymers of the aforementioned styrene polymer, may be selected.

One toner resin is comprised of the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; PLIOLITES ®; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Also, waxes with a molecular weight of from about 1,000 to about 20,000, and preferably 7,000, such as polyethylene, polypropylene, and paraffin waxes, can be included in, or on the toner compositions as fuser roll release agents. The polyesters of U.S. Pat. No. 5,227,460 (D/91117Q) and U.S. Ser. No. 814,641 (D/91117), the disclosures of which are totally incorporated herein by reference, and other linear and branched polyesters can also be selected as the toner resin.

The resin particles are present in a sufficient, but effective amount, for example from about 70 to about 90 weight percent. Thus, when 0.5 percent by weight of the charge enhancing additive is present, and 8 percent by weight of pigment or colorant, such as carbon black, is contained therein, about 91.5 percent by weight of resin is selected. The modified silica particles are usually added to the toner in various effective amounts from about 0.1 to about 2 and preferably from about 0.1 to about 1 weight percent based on the total weight of the final toner.

Numerous well known suitable pigments or dyes can be selected as the colorant for the toner particles including, for example, carbon black like REGAL 330 ®, and other carbon blacks available, for example, from Cabot Corporation, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition.

When the pigment particles are comprised of magnetites, thereby enabling single component toners in some instances, which magnetites are a mixture of iron oxides ($FeO.Fe_2O_3$) including those commercially available as MAPICO BLACK TM, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK TM, in an amount of, for example, from about 5 to about 60, and preferably from about 10 to about 50 weight percent can be selected.

There are blended with the toner compositions of the present invention external metallized silica particles or modified metallized silica flow aid additive particles with a protective coating or layer, which additives are usually present on the surface thereof. Examples of further additives include metal salts and metal salts of fatty acids inclusive of zinc stearate, aluminum oxides, cesium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

With further respect to the present invention, the metallized or modified metallized colloidal silicas can be surface treated with the negatively charge inducing charge additives illustrated herein in an amount of from about 0.1 to about 2 weight percent and preferably about 0.5 weight percent.

Also, there can be included in the toner compositions of the present invention low molecular weight waxes, such as polypropylenes and polyethylenes commercially available from Allied Chemical and Petrolite Corporation, EPOLENE N-15 TM commercially available from Eastman Chemical Products, Inc., VISCOL 550-P TM, a low weight average molecular weight polypropylene available from Sanyo Kasei K. K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Encompassed within the scope of the present invention are colored toner and developer compositions comprised of toner resin particles, optional carrier particles, the optional charge enhancing additives illustrated herein, and as pigments or colorants red, blue, green, brown, magenta, cyan and/or yellow particles, as well as mixtures thereof. Illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles of the present invention are selected to be of a positive polarity enabling the toner particles, which are negatively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances, such as carbon black, in an amount of from about 5 to about 30 percent by weight. Polymer coatings not in close proximity in the triboelectric series can also be selected, reference U.S. Pat. No. 4,937,166 and U.S. Pat. No. 4,935,326, the disclosures of which are totally incorporated herein by reference, including for example KYNAR® and polymethylmethacrylate mixtures (40/60). Coating weights can vary as indicated herein; generally, however, from about 0.3 to about 3, and preferably from about 0.5 to about 2 weight percent coating weight is selected.

Preferred carrier particles are comprised of a steel core solvent coated with a carrier coating of polymethylmethacrylate doped with a conductive carbon black, about 10 to 30 weight percent. Also, there may be selected insulative carriers comprised of a steel core or similar core with a mixture of KYNAR® and polymethylmethacrylate, preferably 60/40 weight percent.

Furthermore, the diameter of the carrier particles, preferably spherical in shape, is generally from about 50 microns to about 1,000, and preferably from about 60 to about 200 microns thereby permitting them to possess sufficient density and inertia to avoid adherence to the electrostatic images during the development process. The carrier component can be mixed with the toner composition in various suitable combinations, such as from about 1 to 5 parts per toner to about 100 parts to about 200 parts by weight of carrier are selected.

The toner and developer compositions of the present invention may be selected for use in electrostatographic imaging apparatuses containing therein layered photoreceptors. Thus, the toner and developer compositions of the present invention can be used with layered photoreceptors that are capable of being charged negatively, such as those described in U.S. Pat. No. 4,265,990, the disclosure of which is totally incorporated herein by reference.

The toner compositions are usually jetted and classified subsequent to preparation to enable toner particles with a preferred average diameter of from about 4 to about 25 microns, and more preferably from about 4 to about 12 microns. Also, the toner compositions of the present invention preferably possess a triboelectric charge of from about a minus (−) 10 to about a minus (−) 50 microcoulombs per gram in embodiments thereof as determined by the known charge spectograph. Admix time for the toners of the present invention in embodiments are preferably from about 5 seconds to about 2 minutes, and more specifically from about 5 to about 1 minute in embodiments thereof as determined by the known charge spectograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

With further respect to the present invention, one developer composition is comprised of a toner composition containing a negatively charging charge enhancing additive, pigment particles, such as carbon black and resin particles, and which toner also contains the metallized silica particles illustrated herein, or modified metallized, especially lithium, AEROSIL® particles illustrated herein, and carrier particles comprised of a core containing thereover a single coating or a plurality, and preferably two polymeric coatings, namely first polymeric coating of, for example, KYNAR®, 60 weight percent, and a second polymeric coating of, for example, polymethylmethacrylate, 40 weight percent, at a total coating weight of 1.25 weight percent, which coatings are not in close proximity in the triboelectric series, reference U.S. Pat. No. 4,937,166 and U.S. Pat. No. 4,935,326, the disclosures of each of these patents being totally incorporated herein by reference. With the aforementioned toners, in some embodiments from about 0.1 to about 10 and preferably about 5 weight percent of the charge enhancing additive can be selected.

The following Examples are being supplied to further define various species of the present invention, it being noted that these Examples are intended to illustrate and not limit the scope of the present invention. Parts and percentages are by weight unless otherwise indicated.

EXAMPLE I

A silica (AEROSIL R972 ® obtained from Degussa Chemical), 4 grams, was suspended in 100 milliliters of methanol inside a 250 milliliter round bottom flask. The acidic silanol groups in the AEROSIL ® were then neutralized by adding to the flask an aqueous solution of lithium hydroxide ($1\times10^{-3}$ N, 4 milliliters) until the pH was 7 as indicated by a pH meter. The resulting mixture was stirred for 1 hour and the solvent methanol was removed by evaporation. The metallized silica comprised of 1 micromole of LiOH on the surface per ~1 gram of silica was obtained after vacuum drying at 80° to 100° C. overnight. 1-Hexadecanol (0.3 gram) was dissolved in ~100 milliliters of hexane inside a 250 milliliter round bottom flask. The above metallized silica (3 grams) was then added and the suspension was stirred overnight, 16 to 20 hours. The hexane solvent was then removed on an evaporator. The residue obtained was placed in a crystallization dish and was dried in an oven overnight at 70° C. The resulting solid was then transferred to a 4 ounce bottle and roll milled with 35 grams of ¼ inch steel shot for 30 minutes at a speed of about 90 feet/minute, yielding ~3 grams of a fluffy white powder, of a modified metallized silica of ~10 percent of 1-hexadecanol on the surface of the LiOH modified R972 ® silica as confirmed by IR.

The above metallized silica (0.063 gram), 9 pm, average volume diameter, unpigmented SPAR ® polyester, a poly(proxylated bisphenol A fumarate) toner (12.5 grams), and 125 grams of ¼ inch steel shot were placed inside a 4 ounce bottle and roll milled for 30 minutes resulting in an experimental toner. Developers were prepared by mixing the above toner (1.25 grams) and 60 grams of a steel core carrier (about 98 μm in diameter) with 0.7 percent by weight of a surface coating of 20 percent of carbon black and 80 percent of poly(methyl methacrylate). The developers were conditioned inside a humidity controlled glove box at a constant RH (either 20 percent or 80 percent RH) overnight. They were then roll milled for 5 minutes at a speed of 90 feet/minute. The toner tribos were determined inside a Faraday Cage by the known blow-off method. The results were:

| 20% RH TRIBO | 80% RH TRIBO |
|---|---|
| −36.1 μC/gram | −16.3 μC/gram |

EXAMPLE II

The processes of Example I were repeated with the exception that NaOH and KOH were used in place of the LiOH in the neutralization process. The resulting metallized modified silicas, which were each comprised of about 1 micromole of either NaOH or KOH on each gram of AEROSIL R972 ®, were then evaluated in a SPAR TM toner with the procedures described in Example I. The toner tribos were:

| BASE | 20% RH TRIBO | 80% RH TRIBO |
|---|---|---|
| NaOH | −26.9 μC/gram | −12.8 μC/gram |
| KOH | −34.3 μC/gram | −10.4 μC/gram |

EXAMPLE III

The processes of Example I were repeated with the exception that either LiOH, NaOH or KOH was used as a base, and the charge additive BONTRON E88 TM, 1:10 relative to the silica, was used in place of 1-hexadecanol in the solution coating step. This resulted in metallized silicas of about 10 percent of BONTRON E88 TM on the metallized silica surfaces. The silicas were then evaluated in a SPAR TM toner with the procedure of Example I. The toner tribo results were:

| BASE | 20% RH TRIBO | 80% RH TRIBO |
|---|---|---|
| LiOH | −32.1 μC/gram | −12.5 μC/gram |
| NaOH | −31.6 μC/gram | −11.2 μC/gram |
| KOH | −30.3 μC/gram | −10.7 μC/gram |

EXAMPLE IV

There was prepared an alcohol grafted silica from AEROSIL 130 ® obtained from Degussa Chemical and 1-dodecanol. The hydrophilic silica A130 ® (3 grams, 16 nanometers diameter) was activated in a furnace at about 600° C. for 3 to 4 hours. It was then transferred to a 250 milliliter three neck flask containing a mixture of 1-dodecanol (about 50 milliliters) and n-hexadecane (about 50 milliliters). The resulting dispersion was heated to a bath temperature of 260° C. to 280° C. for 16 hours under a nitrogen atmosphere. The silica product comprised of ~6.5 percent by weight of 1-dodecanol grafted on the silica surface was cooled to room temperature and was isolated by filtration. After washing thoroughly with ~100 milliliters of methanol to remove residual hexadecane and 1-dodecanol, the solid obtained was dried in a vacuum oven overnight at 70° C. to 80° C. A new hydrophobic silica of 3.3 grams ~6.5 percent by weight, of 1-dodecanol grafted on the surface was obtained.

About 3 grams of the above prepared alcohol grafted silica were suspended in 100 milliliters of methanol inside a 250 milliliter round bottom flask. The suspension was then neutralized by adding 3 milliliters of an aqueous solution of lithium hydroxide ($1\times10^{-3}$ N) until the reading in the pH meter was 7.0. The resulting mixture was stirred for one hour and the solvent methanol was removed by evaporation at room temperature. The resulting metallized silica comprised of 1 gram (g) of LiOH for each gram of alcohol grafted silica was obtained after vacuum drying at 80° C. to 100° C. overnight. The solid was then transferred to a 4 ounce bottle and roll milled with 35 grams of ¼ inch steel shot for 30 minutes at a speed of 90 feet/minute, yielding ~3 grams of a fluffy white modified silica similar in composition to Example II. Toner and developers were then prepared according to the procedures of Example I. The toner tribo results were:

| 20% RH TRIBO | 80% RH TRIBO |
|---|---|
| −32.3 μC/gram | −12.2 μC/gram |

EXAMPLE V

The metallized silica prepared in Example IV, 3 grams, was added to a solution containing 0.3 gram of 1-hexadecanol in 100 milliliters of n-hexane utilizing the alcohol coating procedures of Example I, and yielding 3.3 grams of a modified silica that contains, microgram of LiOH per gram of silica and ~6.5% by weight of 1-dodecanol grafted on the surface. Toner and developers were prepared from the modified silica with the procedures of Example I. The toner tribo results were:

| 20% RH TRIBO | 80% RH TRIBO |
|---|---|
| −25.9 μC/gram | −14.7 μC/gram |

EXAMPLE VI

There was prepared a metallized silica comprised of ~18 percent 1-dodecanol grafted on the silica surface followed by applying ~3 μg (micrograms) per gram of LiOH on the silica surface, by repeating the procedures of Example V with the exception that AEROSIL 300® obtained from Degussa Chemical was used in place of A130®. A modified metallized silica was also prepared by coating 0.6 gram of 1-hexadecanol onto 3 grams of the prepared metallized silica. Toner and developers were prepared by the procedures of Example I. The toner tribo results were:

| | 20% RH TRIBO | 80% RH TRIBO |
|---|---|---|
| Metallized Silica | −39.7 μC/gram | −16.2 μC/gram |
| Modified Metallized Silica | −33.8 μC/gram | −16.8 μC/gram |

COMPARATIVE EXAMPLE 1

Commercially available silicas, such as hydrophilic silica A130® and A300® obtained from Degussa Chemical, hydrophobic silicas R972® and R812® obtained from Degussa Chemical, and TS530™ obtained from Cabot Corporation were used to formulate toners and developers by the procedures described in Example I. The toner tribo results were:

| SILICA | PARTICLE SIZE | 20% RH TRIBO | 80% RH TRIBO |
|---|---|---|---|
| A130 | 16 nm | −25.1 μC/gram | −1.9 μC/gram |
| A300 | 7 nm | −33.1 μC/gram | −6.1 μC/gram |
| R972 | 16 nm | −26.4 μC/gram | −4.9 μC/gram |
| R812 | 7 nm | −39.1 μC/gram | −11.4 μC/gram |
| TS530 | 7 nm | −34.9 μC/gram | −13.0 μC/gram |

The above results indicate that the modified metallized silicas of the present invention generate superior tribo values, especially at high (80 percent) RH and taking into consideration the particle size.

EXAMPLE VII

There was prepared in an extrusion device, available as ZSK28 from Werner Pfeiderer, a toner composition by adding 95 percent of the crosslinked SPAR™ indicated herein, reference U.S. Pat. No. 5,227,460, the disclosure of which is totally incorporated herein by reference, and 5 percent of carbon black REGAL 330®. The toner product was melt extruded at ~160° C., jetted and classified to about 9 microns. Modified metallized silicas, prepared in Examples V and VI, 0.063 gram, were blended into the above black toner (12.5 grams) inside a 4 ounce bottle by roll milling the mixture with 125 grams of ¼ inch steel shot on a roll mill for 30 minutes.

Developers were then prepared with the above prepared black toners (1.25 grams) and 60 grams of a ~98 μm steel core carrier of about ~1 percent of a surface coating of 20 percent carbon black and 80 percent PMMA. The developers were then placed or conditioned inside a humidity controlled glove box at a constant RH (20 percent or 80 percent RH) for 16 to 20 hours. They were then roll milled for 30 minutes at a speed of 90 feet/minute. The toner tribos were then determined by the standard Faraday Cage blow-off method. The results are:

| | 20% RH TRIBO | 80% RH TRIBO |
|---|---|---|
| Modified Silica in Example V | −23.2 μC/gram | −13.6 μC/gram |
| Modified Silica in Example VI | −27.0 μC/gram | −15.2 μC/gram |

COMPARATIVE EXAMPLE 2

The toner and the developer preparative procedures of Example VII were repeated with the exception that a hydrophobic silica (R972® obtained from Degussa Chemical) was used in place of the modified silicas. The toner tribo results were:

| | 20% RH TRIBO | 80% RH TRIBO |
|---|---|---|
| AEROSIL R972® | −23.7 μC/gram | −10.4 μC/gram |

Under parallel conditions, the silicas in Example VII provided a higher tribo at 80 percent RH, consequently, the changes in tribo level from 20 percent RH to 80 percent RH were relatively smaller for the toners of the present invention.

EXAMPLE VIII

There was prepared a yellow toner composition with the process in Example VII with the exception that the toner composition was comprised of 87.5 percent SPAR™ resin and 12.5 percent LUPRETON™ yellow. The toner was melt extruded, jetted and classified to about ~7 μm. Modified silicas prepared in Example V and Example VI were blended into the above yellow toner (12.5 grams) inside a 4 ounce bottle by roll milling the mixture with 125 grams of ¼ inch steel shot on a roll mill for 30 minutes.

Developers were then prepared with the yellow toner (4.02 grams) and 100 grams of a ~65 μm steel core carrier comprised of a 1.6 percent surface coating of 20 percent carbon black and 80 percent PMMA. The developers were then conditioned to constant relative humidities and evaluated as Example VII. The toner tribo results were:

| | 20% RH TRIBO | 80% RH TRIBO |
|---|---|---|
| Modified Silica in Example V | −30.5 μC/gram | −16.1 μC/gram |
| Modified Silica in Example VI | −35.2 μC/gram | −20.0 μC/gram |

COMPARATIVE EXAMPLE 3

The toner and the developer procedures of Example VIII were repeated with the exception that a hydrophobic silica (R972 ®) obtained from Degussa Chemical) was used in place of the modified silicas of the present invention. The tribo results were:

| | 20% RH TRIBO | 80% RH TRIBO |
|---|---|---|
| AEROSIL R972 ® | −29.1 μC/gram | −11.2 μC/gram |

Specifically, for example, the toner tribos at 80 percent RH are significantly higher for the modified silicas of the present invention. Thus, the changes in tribo level from 20 percent RH to 80 percent RH are relatively smaller.

Other modifications of the present invention may occur to those skilled in the art subsequent to a review of the present application, and these modifications, including equivalents thereof, are intended to be included within the scope of the present invention.

What is claimed is:

1. A toner composition comprised of resin, pigment, optional charge additive and a flow aid surface additive comprised of hydrophobic metallized silica of a size diameter of from about 5 to about 40 nanometers, and which silica has been treated with a long chain aliphatic alcohol.

2. A negatively charged toner composition comprised of resin, pigment, optional negative inducing charge additive and a flow aid surface additive comprised of metallized hydrophobic silica of a size diameter of from about 5 to about 40 nanometers, and which silica contains adsorbed on its surface a hydrocarbon layer originating from a long chain aliphatic alcohol.

3. A toner in accordance with claim 2 wherein the long chain aliphatic alcohol has a carbon chain length of from about 12 to about 30 carbon atoms, and the silica is metallized with lithium hydroxide, sodium hydroxide or potassium hydroxide.

4. A toner in accordance with claim 2 wherein the long chain alcohol has a carbon chain length of from about 12 to about 20 carbon atoms.

5. A toner in accordance with claim 2 wherein the long chain alcohol is hexadecanol, tetradecanol, octadecanol, pentadecanol, and eicosanol, the silica is of a diameter of from about 5 to about 20 nanometers, and the toner is of an average volume diameter of from about 4 to about 20 microns.

6. A toner in accordance with claim 2 wherein the silica is hydrophobic and the triboelectrical charge of the toner is from about ~10 to about ~50 microcoulombs per gram.

7. A toner in accordance with claim 2 wherein the resin is a styrene acrylate, a styrene methacrylate, a styrene butadiene, or a polyester.

8. A toner in accordance with claim 7 wherein the polyester is a crosslinked polyester.

9. A toner in accordance with claim 7 wherein the polyester is poly(proxylated bisphenol A fumarate).

10. A toner in accordance with claim 2 wherein the pigment is carbon black, magnetite, cyan, magenta, yellow, or mixtures thereof.

11. A toner in accordance with claim 2 wherein the charge additive is a metal complex.

12. A toner in accordance with claim 2 further containing surface additives of metal salts of a fatty acid, or metal oxides.

13. A toner in accordance with claim 12 wherein said metal salts are zinc stearate, and said oxides are titanium dioxide, tin oxide, or silicon oxide present in effective amounts of from about 0.1 to about 2 weight percent of the toner.

14. A developer comprised of the toner of claim 1 and carrier particles.

15. A developer comprised of the toner of claim 2 and carrier particles.

16. A developer in accordance with claim 15 wherein the carrier is comprised of a metal core with a coating thereover.

17. A developer in accordance with claim 16 wherein the carrier core is comprised of ferrites, steel, or an iron powder; and the coating is comprised of a methyl terpolymer, a polyvinylidine fluoride, a polymethylmethacrylate, or a mixture of polymers not in close proximity in the triboelectric series.

18. A developer in accordance with claim 16 wherein the carrier core is comprised of steel; and the coating is comprised of polymethylmethacrylate doped with carbon black.

19. A developer in accordance with claim 18 wherein the carbon black is present in an amount of from about 10 to about 25 percent by weight.

20. A toner composition in accordance with claim 2 wherein a charge additive is present in an amount of from about 0.1 to about 3 weight percent.

21. A toner composition in accordance with claim 2 with an admix time of from less than about 60 seconds.

22. A toner composition in accordance with claim 2 containing a wax component with a weight average molecular weight of from about 1,000 to about 10,000.

23. A toner composition in accordance with claim 22 wherein the wax component is selected from the group consisting of polyethylene and polypropylene.

24. A toner composition in accordance with claim 1 wherein the pigment is carbon black, magnetites, or mixtures thereof, cyan, magenta, yellow, red, blue, green, brown, and mixtures thereof.

25. A toner composition in accordance with claim 2 wherein there is generated a protective coating on said metallized silica by the attachment and interaction of hydrocarbon chains present on said long chain aliphatic alcohol.

26. A toner composition comprised of resin, pigment, optional charge additive and a flow aid surface additive comprised of hydrophobic metallized silica and which silica has been treated with a long chain aliphatic alcohol.

27. A composition comprised of resin, pigment and modified metallized silica particles which particles contain a protective coating thereon formed from the adsorption on said silica of a long chain aliphatic alcohol.

28. A toner in accordance with claim 1 wherein said silanol groups on the surface of the hydrophobic silicon are neutralized by a metal hydroxide.

29. A toner in accordance with claim 1 wherein the silica is metallized with a metal hydroxide.

* * * * *